United States Patent [19]

Baron

[11] 4,085,854

[45] Apr. 25, 1978

[54] PITCH STOP ASSEMBLY FOR POWER SHOVELS

[75] Inventor: George B. Baron, Marion, Ohio

[73] Assignee: Marion Power Shovel Co., Inc., Marion, Ohio

[21] Appl. No.: 619,453

[22] Filed: Oct. 3, 1975

[51] Int. Cl.[2] ..... E02F 3/32

[52] U.S. Cl. ..... 214/138 R; 214/142

[58] Field of Search ..... 214/135 R, 135 A, 136, 214/137, 138 R, 142

[56] References Cited

U.S. PATENT DOCUMENTS

| | | | |
|---|---|---|---|
| 1,681,282 | 8/1928 | Clutter | 214/138 R |
| 2,776,766 | 1/1957 | Sanderson | 214/138 R |
| 3,501,034 | 3/1970 | Baron | 214/138 R |
| 3,648,863 | 3/1972 | Baron et al. | 214/138 R |
| 3,856,161 | 12/1974 | Baron | 214/138 R |

*Primary Examiner*—Drayton E. Hoffman
*Assistant Examiner*—Ross Weaver
*Attorney, Agent, or Firm*—Mason, Fenwick & Lawrence

[57] ABSTRACT

In a power shovel including a base unit; a support unit rotatably mounted on the base unit; a front end assembly including a stiffleg pivotally connected at a lower end thereof to the support unit, a dipper handle operatively connected to the stiffleg, a dipper pivotally connected to the dipper handle, a hoist frame pivotally connected to the stiffleg, and a hoist link pivotally connected at the ends thereof to the hoist frame and the dipper, the dipper handle, dipper, hoist link and hoist frame defining a four bar linkage; a crowd system operatively interconnecting the support unit and the front end assembly; a hoist system operatively interconnecting the support unit and the front end assembly; and control means mounted on the support means for operating the crowd and hoist systems to crowd, hoist, lower and retract the dipper, a pitch stop assembly comprising a collapsible tension member interconnecting the hoist link and dipper of the front end assembly for limiting the angular displacement of the dipper relative to the dipper handle when the dipper is caused to pitch upwardly.

30 Claims, 12 Drawing Figures

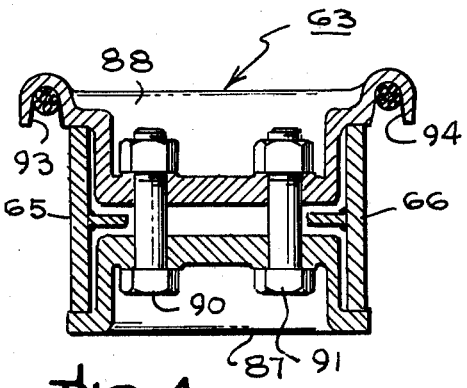
FIG-4
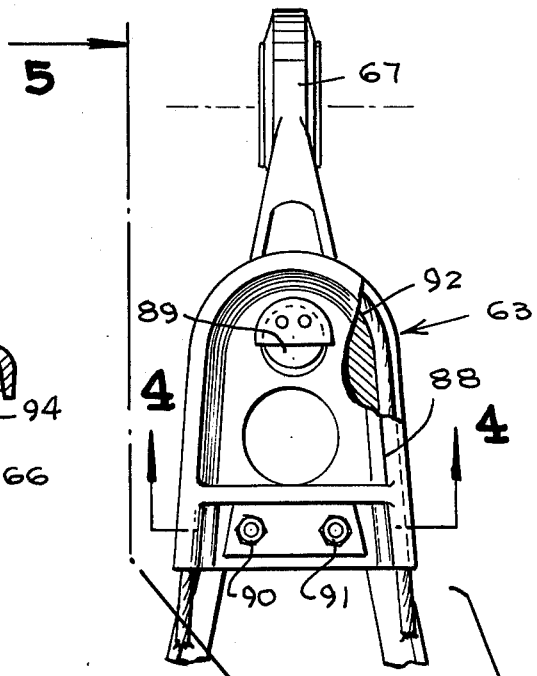
FIG-3
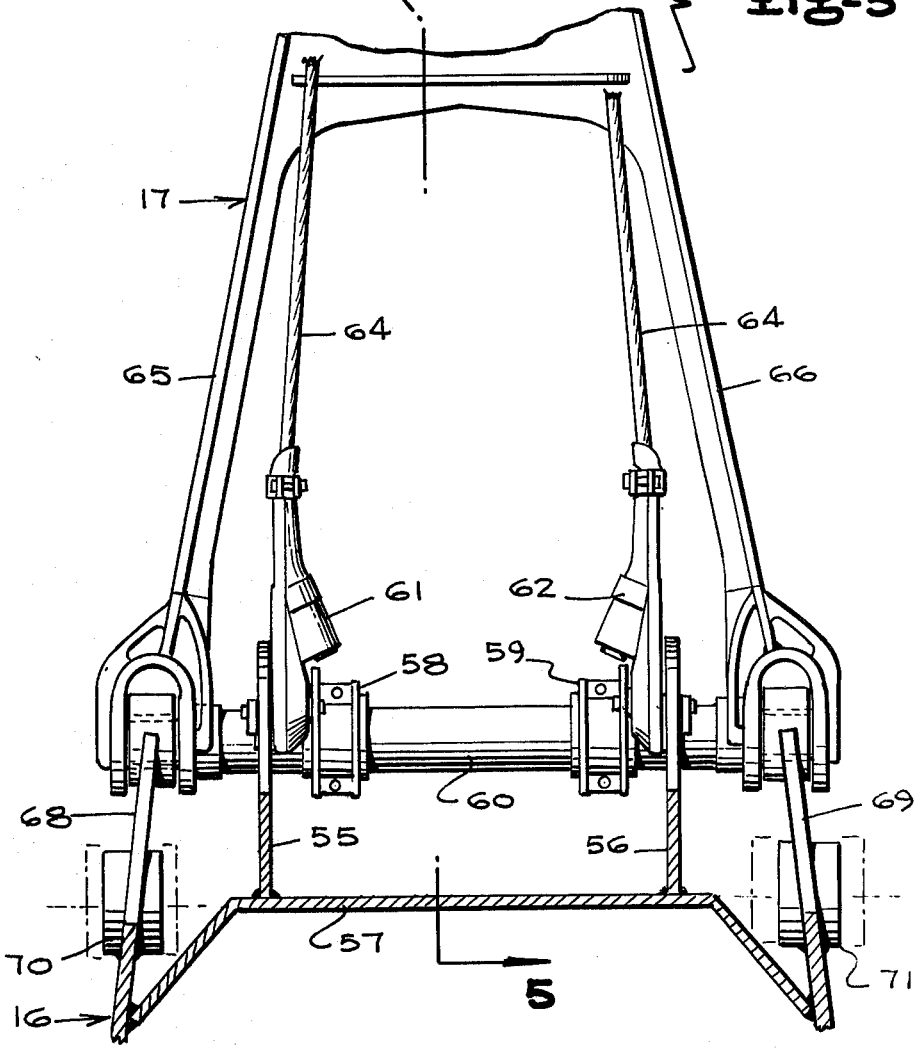

PITCH STOP ASSEMBLY FOR POWER SHOVELS

The present invention relates to a power shovel of the type disclosed in U.S. Pat. Nos. 3,501,034; 3,648,864 and 3,856,161, which generally includes a lower frame mounted on a crawler assembly, an upper frame rotatably mounted on the lower frame, a front end assembly including a stiffleg pivotally connected at a lower end thereof to the upper frame, a dipper handle operatively connected to the stiffleg, a dipper pivotally connected to the dipper handle, a hoist frame pivotally connected to the stiffleg and a hoist link pivotally connected at the ends thereof to the hoist frame and the dipper handle. Basically, the dipper handle, dipper, hoist link and hoist frame are pivotally connected together to form a four bar linkage. In addition, there is provided in such type of shovel, a crowd system mounted on the upper frame and operatively connected to the front end assembly, a hoist system mounted on the upper frame and operatively connected to the front end assembly, and control means also mounted on the upper frame for operating the crowd and hoist systems to crowd, hoist, lower and retract the dipper. Additionally, there is provided a mechanism for controlling the pitch of the dipper during the crowding phase of the digging cycle of such a shovel to provide a horizontal line of travel of the dipper for maximizing the filling of the dipper, thus enhancing the operating efficiency of the shovel.

In such type of shovel, at the end of the crowding phase of the digging cycle, when the pitch control system is released, the dipper is adapted to pitch upwardly. In the prior art, such upward pitching of the dipper has been limited by means of a pitch stop assembly mounted on the dipper handle. Such assembly generally has consisted of a pair of elongated structural members mounted on the side beams of the dipper handle at a small angle thereto, having end portions which are engaged by abutment members mounted on the dipper. Such type of assembly more fully is illustrated and described in the aforementioned patents.

The aforementioned type of pitch stop assembly has several disadvantages. Initially, such an assembly adds a considerable amount of weight to the front end assembly and particularly in the area of the head shaft, a condition which is desired to be avoided. Secondly, because of the magnitude and direction of forces applied to the dipper handle when the dipper with a full load pitches upwardly and strikes the pitch stop assembly, the dipper handle must be reinforced to withstand such load thus complicating the construction of the dipper handle. Accordingly, it has been found to be desirable to provide a pitch stop assembly for the type of shovel as described, which would eliminate the aforementioned disadvantages of such a pitch stop assembly.

Accordingly, it is the principal object of the present invention to provide an assembly for limiting the upward pitch of a dipper in a power shovel.

Another object of the present invention is to provide a novel pitch stop assembly for a power shovel provided with a front end assembly including a dipper handle operatively connected to a stiffleg, a dipper pivotally connected to the dipper handle, a hoist frame pivotally connected to the stiffleg and a hoist link pivotally connected to the hoist frame and dipper, wherein the dipper handle, dipper, hoist link and hoist frame form a four bar linkage.

A further object of the present invention is to provide a novel assembly mounted on the front end assembly of a power shovel for limiting the upward pitch of the dipper thereof which adds a minimum amount of weight to the front end assembly, particularly in the area of the head shaft thereof.

A still further object of the present invention is to provide a novel assembly mounted on the front end assembly of a power shovel for limiting the upward pitch of the dipper thereof which is adapted to restrain the upward pitch of the dipper without applying any bending forces on the dipper handle of the shovel.

Another object of the present invention is to provide a novel assembly mounted on the front end assembly of a power shovel for limiting the upward movement of the dipper relative to the dipper handle which eliminates the necessity of special reinforcing of the dipper handle for withstanding the impact resulting when the upward pitch of the dipper is restrained.

Other objects and advantages of the present invention will become more apparent to those persons having ordinary skill in the art to which the present invention pertains, from the following description taken in conjunction with the accompanying drawings, wherein;

FIG. 3 is an enlarged cross-sectional view taken along line 3—3 in FIG. 1;

FIG. 4 is a cross-sectional view taken along line 4—4 in FIG. 3;

Figure 1:
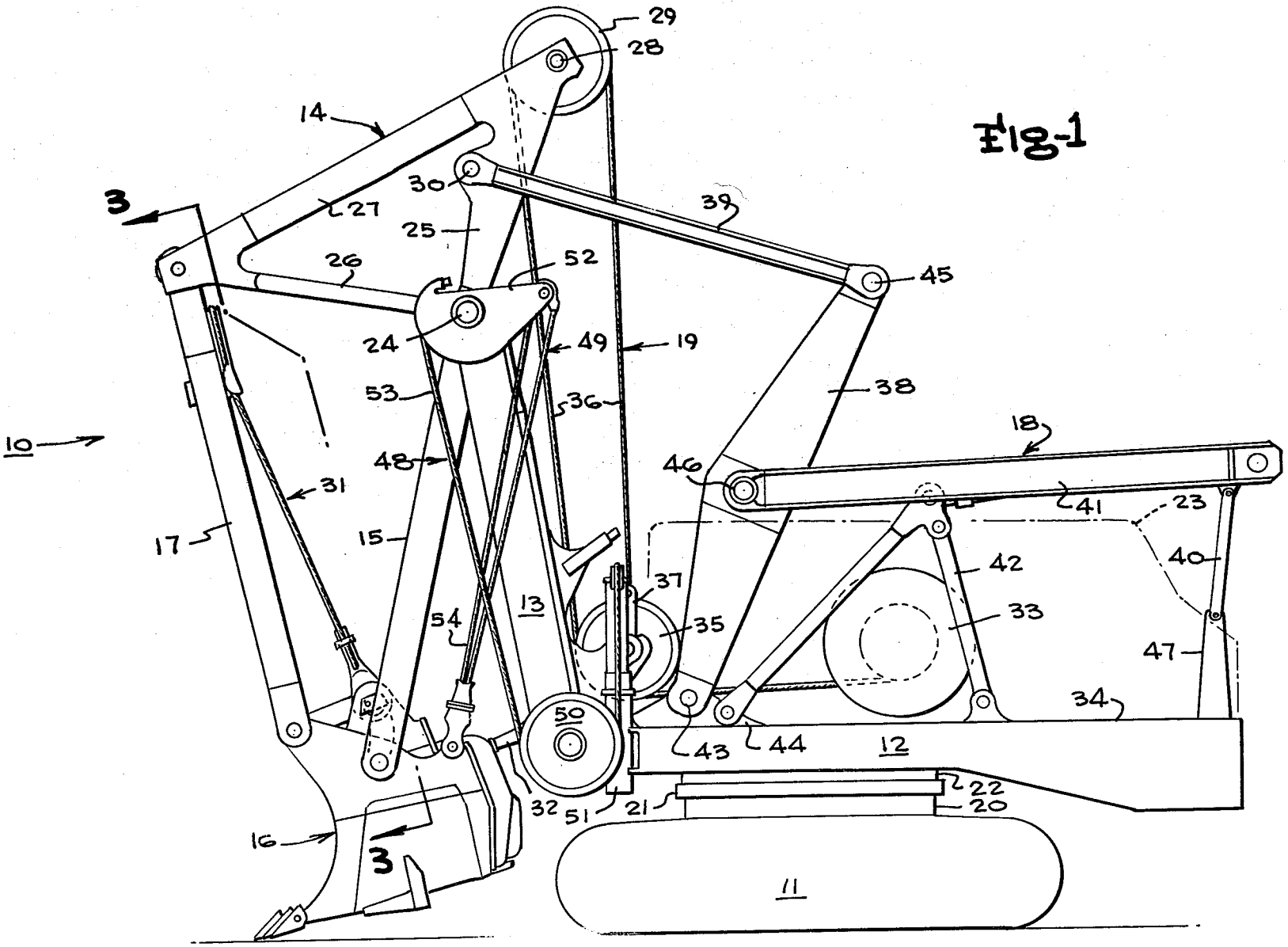
FIG. 1 is a side elevation view of a power shovel including an embodiment of the present invention.

Referring to FIG. 1, there is illustrated a power shovel 10 generally including a crawler unit 11, a main frame 12 rotatably mounted on the crawler unit, a stiffleg 13 pivotally connected at a lower end thereof to the main frame, a hoist frame 14 pivotally connected to the upper end of stiffleg 13, a dipper handle 15 pivotally connected to the outer end of stiffleg 13 (although the dipper handle alternatively may be pivotally connected to hoist frame 14), a dipper 16 pivotally connected to the outer end of dipper handle 15, a hoist link 17 pivotally connected to hoist frame 14 and dipper 16, a crowd system 18 mounted on main frame 12 and operatively connected to hoist frame 14, and a hoist mechanism 19 mounted on main frame 12 and operatively connected to hoist frame 14.

Crawler unit 11 may be of any conventional design and has mounted thereon a lower frame 20 which supports a conventional roller circle 21. An upper frame 22 is seated on the roller circle and is adapted to support main frame 12. Appropriate machinery is provided on main frame 12 to drive the crawler unit and swing the upper frame 12 and main frame 22 about a center journal relative to lower frame 20 and the crawler unit, as is conventional in the prior art. Such propelling and swing machinery is housed in a cab structure 23 provided on the main frame 12 which also houses other machinery and components of the shovel as later will be described.

The lower end of stiffleg 13 is bifurcated, providing a pair of feet which are pivotally connected to main frame 12 by means of a pair of foot pins thus permitting the stiffleg to be pivoted in a vertical plane. The outer, upper end of stiffleg 13 is provided with a head shaft 24 on which there is pivotally mounted various components including the dipper handle and hoist frame. Dipper handle 15 generally consists of a pair of transversely spaced, longitudinally disposed beams pivotally connected at the outer ends thereof to the side walls of the dipper, and pivotally connected at the upper ends thereof to head shaft 24.

Hoist frame 14 has substantially a triangular configuration and includes a base member 25 pivotally mounted on head shaft 24, a post member 26 being disposed substantially perpendicular to base member 25 and having the lower end thereof integrally connected to the front end of the base member, and a tension member 27 integrally interconnecting the upper end of the post member 26 and the rear end of base member 25. In an alternate embodiment of the hoist frame in which the upper end of the dipper handle is pivotally connected to the hoist frame, the forward end of base member 25 is bifurcated, providing a pair of forwardly projecting arm portions to which the upper end of the dipper handle is pivotally connected. As illustrated in FIG. 1, a shaft 28 is provided at the rear end of base member 25 on which there is rotatably mounted a hoist sheave 29 for operatively connecting the hoist system to the hoist frame, as later will be described. Also mounted on the base member substantially intermediate the head shaft and hoist sheave support shaft is a rigidly mounted connecting pin 30 for operatively connecting the crowd system to the hoist frame.

Dipper 16 is substantially of a conventional construction including a pair of transversely spaced side walls, a bottom wall, a plurality of digging teeth detachably mounted on the front lip of the bottom wall, a top wall and a releasable door pivotally connected at its upper end to the side walls of the dipper. The dipper is adapted normally to pitch upwardly, the upward pitch being limited by a pitch stop assembly 31 interconnecting the hoist frame and the dipper. When the dipper is in the lower, fully retracted position, it is prevented from striking the lower end of the stiffleg by means of an abutment stop 32 mounted on the lower end of the stiffleg and engageable by the rear end of the dipper.

Hoist frame 19 is substantially conventional in design and generally includes a hoist drum and drive 33 mounted on support platform or main deck 34 of main frame 12 within the cab structure, a sheave 35 mounted on the lower end of the stiffleg and a hoist line 36 operatively connected at one end to hoist drum 33, passing around sheaves 35 and 29 and being dead-ended at the lower end of the stiffleg, as at 37. As in the conventional manner, whenever the hoist line is either payed out or taken in, hoist frame 14 and correspondingly dipper handle 15, dipper 16 and hoist link 17 will be caused to pivot about the head shaft mounted on the upper end of the stiffleg.

Crowd system 18 generally consists of a linkage and a fluid actuating system mounted on the main frame of the shovel and operatively connected to the actuating components of the linkage. The linkage includes a mast 38, a pair of connecting links 39, a pair of transversely spaced support links 40, a cylinders disposed between the crowd links substantially in the same plane thereof. Mast 38 is pivotally connected at the lower end thereof by means of a pin or pins 43 to mounting brackets 44 disposed on support platform 34 and rigidly secured to main frame 12, forwardly of the vertical center line of rotation of the main frame. Mounted on the upper end of the mast is a transversely disposed connecting pin 45, to which the rearwardly disposed ends of connecting links 39 are pivotally connected. The mast further is provided with a transversely disposed shaft 46 disposed intermediate the ends thereof, having the end portions thereof projecting laterally of the side walls of the mast. Crowd links 41 are pivotally connected at the forward ends thereof to the laterally projecting portions of shaft 46 and are pivotally connected at the rearward ends thereof to the upper ends of support links 40. The lower ends of support links 40 are pivotally connected to brackets 47 secured to the main frame at the rear end thereof.

Gantry 33 is rigidly mounted on the main deck between mast 38 and support links 40, having the upper end thereof disposed between drive links 41, intermediate the ends thereof. The hydraulic cylinder assemblies are pivotally connected at the forward ends thereof to the upper end of gantry 42 and are pivotally connected at the rearward ends thereof to a cross-piece member journaled in the rearward ends of the crowd links. It thus will be seen that by operating the cylinders, the front end assembly will be permitted to pivot forwardly or be pivoted rearwardly to correspondingly crowd and retract the dipper in the conventional manner during the digging cycle of the shovel.

During the crowding phase of the digging cycle of the shovel, the pitch of dipper 16 can be maintained fixed relative to the main frame of the shovel by means of a pitch control system 48 consisting of a pair of pantograph linkages 49 mounted on opposite sides of the stiffleg and dipper handle, a pair of sheaves 50 mounted on the foot pins of the stiffleg, and a pair of fluid actuated piston and cylinder assemblies 51 having the cylinders thereof ridigly secured to the main frame. The pantograph linkages are substantially identical in construction and operation. As illustrated in FIG. 1 and described in greater detail in U.S. Pat. Nos. 3,501,034 and 3,648,863, each linkage consists of a bell crank 52 pivotally mounted on an outer end of head shaft 24, a pitch link 53 connected at one end thereof to the forwardly disposed end of the pitch bell crank, reaved about sheave 50 and connected at the opposite end thereof to the piston portion of cylinder assembly 51, and a pitch link 54 connected at one end thereof to a rearwardly disposed point on the pitch bell crank and connected at the opposite end thereof to a side wall of the dipper.

The dipper pitch control system as described operates in a manner whereby whenever the pistons of cylinder assemblies 51 are permitted to float freely, the pitch of the dipper will be permitted to change with respect to the forces imposed thereon by its own weight or contact of the dipper with the ground or material being excavated. However, upon locking the pistons of the cylinder assemblies, the pantograph linkages will cause the pitch of the dipper to become fixed relative to the main frame of the shovel until such pistons are released and again permitted to float freely.

In the operation of the embodiment as described, the front end assembly of the shovel is positioned at the beginning of the digging cycle by operating the crowd system to pivot the stiffleg to its rearmost position, operating the hoist system to lower the dipper downwardly and rearwardly to a position adjacent the stiffleg, engaging abutment 32, and rendering inoperative the holding means of the dipper pitch control system so that the dipper will be caused to pitch upwardly. In retracting the front end assembly to so position the dipper, fluid under pressure is supplied to the front ends of the crowd cylinders to extend the pistons thereof. Such action of the crowd cylinders will pivot mast 38 to the position as illustrated in FIG. 1.

With the front end assembly in its fully retracted position as described, the digging cycle of the shovel may commence merely by permitting fluid to be discharged from the piston ends of the crowd cylinders, and possibly supplying fluid under pressure to the rod ends of the cylinders. Such action causes the pistons of the crowd cylinders to retract, correspondingly causing the stiffleg to pivot downwardly under the force of the weight of the front end assembly and possibly any force exerted by the crowd system. Simultaneously, the hoist system is operated to take in hoist line and permit the dipper handle to pivot forwardly, away from the stiffleg, to provide a knee-type action characteristic of the type of shovel described. As such knee-action progresses, the dipper will be caused to pivot so that the bottom wall thereof will be at ground level, in a horizontal position. The operator then actuates certain controls to lock the piston of holding cylinders 51, whereupon, as the knee-action of the front assembly continues, the dipper pitch control system will cause the pitch of the dipper to remain fixed and the dipper to be crowded into the material being excavated, along a horizontal line of travel, to a maximum extended position.

At the end of the crowding phase of the digging cycle, when the dipper has made its maximum penetration into the material being excavated, the operator actuates appropriate controls to provide fluid under pressure to the piston ends of the crowd cylinders to extend the pistons thereof and correspondingly retract the front end assembly. Simultaneously, the operator actuates appropriate controls to release the piston of holding cylinders 51 thus permitting the dipper to pitch upwardly until restrained by pitch stop assembly 31. As such action occurs, the hoist line continues to be taken in thus causing the dipper to be hoisted until it reaches a dump position. In such position, the dumping door of the dipper will be disposed substantially horizontally and the dipper will be filled with a maximum load of material ready to be dumped. The swing machinery on the shovel may then be operated to swing the dipper to a position over the location where the material is to be dumped, and the door may be unlatched to discharge the material. From such point on, the hoist system is operated to pay out hoist line and the swing machinery is operated to return the front end assembly into position to begin the next digging cycle.

Pitch stop assembly 31 is best illustrated in FIGS. 3 throught 5. Basically, the assembly consists of a pair of transversely spaced, slotted connecting plates 55 and 56 rigidly secured to a top wall 57 of the dipper, a pair of rearwardly disposed tension arms 58 and 59 projecting rearwardly and disposed substantially radially relative to a shaft 60 disposed at the lower end of the hoist frame, a pair of connecting links 61 and 62 rigidly connected to the rearward ends of tension arms 58 and 59 and operatively connected to slotted plates 55 and 60, a yoke assembly 63 mounted on the upper end of the hoist link, and a wire rope 64 being rigidly connected at one end thereof to connecting link 62, passing around the upper end of yoke assembly 63 and being rigidly connected at its opposite end to connecting link 62.

As best illustrated in FIG. 3, hoist link 17 has a substantially inverted, V-shaped configuration including side beam members 65 and 66 merging together at the upper ends thereof and being provided with a portion 67 adapted to be pivotally connected by means of a ball-type joint to the hoist frame, and interconnected at the lower ends thereof by means of transversely disposed shaft 60.

Figure 5:
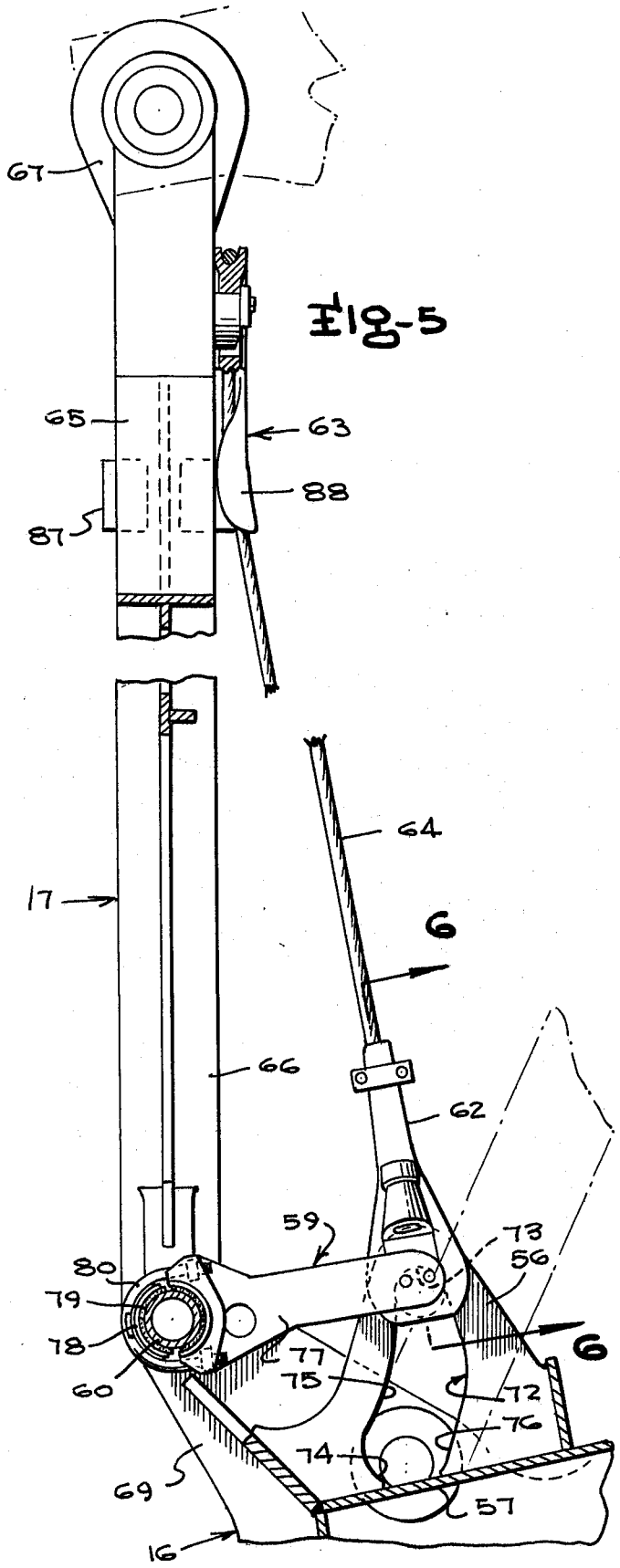
FIG. 5 is a cross-sectional view taken along line 5—5 in FIG. 3.

As best illustrated in FIGS. 1, 3 and 5, the side walls of the dipper are provided with upwardly and forwardly projecting portions 68 and 69 which are pivotally connected to pins disposed in alignment with shaft 60 to pivotally connect the dipper to the hoist link, and are provided with rearwardly disposed fixtures 70 and 71 for pivotally connecting the dipper to the lower end of the dipper handle. Slotted plates 55 and 56, are spaced inwardly from dipper side walls portions 68 and 69, equidistantly from the center of the dipper and parallel to each other. Plate 56 is provided with an arcuate slot 72, as best illustrated in FIG. 5, having the axis of shaft 60 as the center of curvature. Slot 72 provides a pair of arcuately spaced abutment surfaces 73 and 74 and slightly diverging, arcuate side surfaces 75 and 76. Plate 55 is provided with a similar, transversely aligned slot.

Tension arms 58 and 59 are substantially identical in construction and operation. FIG. 5 best illustrates tension arm 59 which consists of an elongated main body portion 77 having a substantially semicylindrical front end surface engaging a brake lining 78 provided on shaft 60, and a retainer portion 79 also provided with a semicylindrical surface engaging brake lining 78. The two portions of tension arm 59 are clamped rigidly on the brake lining material provided on shaft 60 by means of U-bolts 80.

By virtue of the type of mounting of tension arms 58 and 59, it will be appreciated that under loads below a predetermined amount, the tension arms will be caused to pivot with the hoist link relative to the dipper, and upon the tension arms being subjected to loads above such predetermined amount, they will be caused to slip about the brake linings and be displaced angularly relative to the hoist link, as will later be described.

Figure 6:
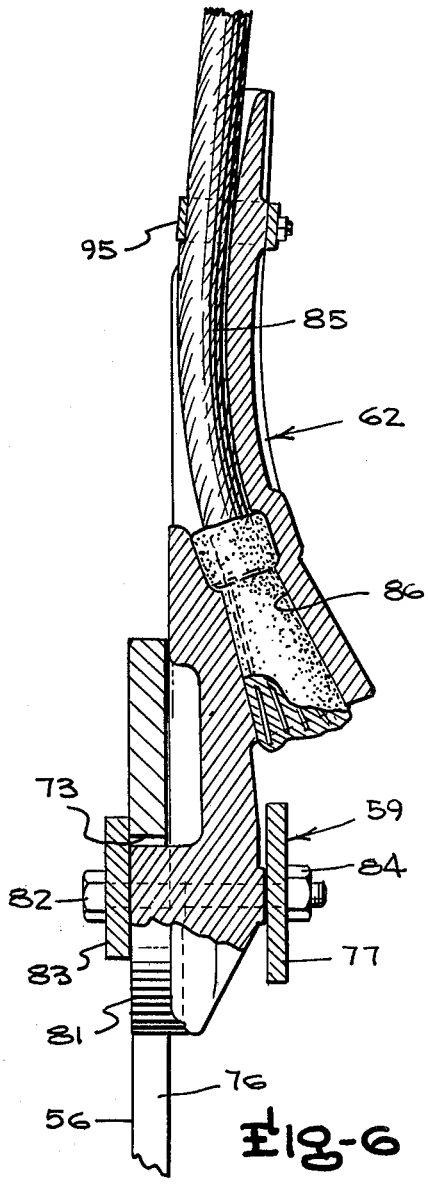
FIG. 6 is an enlarged cross-sectional view taken along line 6—6 in FIG. 5.

Connecting links 61 and 62 also are similar in construction and operation. Referring to FIG. 6, connecting link 62 is provided at the lower end thereof with a stub shaft portion 81 which projects into arcuate slot 72 and is adapted to ride along the length thereof, being restrained only upon engagement with arcuately spaced abutment surfaces 73 and 74 of the slot. The lower end of connecting link 62 is rigidly secured to the rear end of tension arm 59 by means of a pair of bolts 82 passing through aligned openings in a retainer plate 83, the lower end of connecting link 62 and the rear end of arm 59, and a pair of nuts 84. As will later be described, the upper end of connecting link 62 is provided with elongated recess 85 merging into an offset, flared opening 86 in the intermediate portion of the connecting link. Connecting link 61 is of a similar construction, being rigidly connected on the rear end of tension arm 58 and being provided with a stub shaft portion projecting into and movable along the length of the arcuate slot in slotted plate 55.

As best illustrated in FIGS. 3 and 4, yoke assembly 63 consists of a front plate member 87 and a rear plate member 88 mounted on a pin 89 on the upper end of the hoist link and rigidly secured to side beam members 65 and 66 by means of bolt and nut sets 90 and 91. The upper end of plate member 88 is provided with a semicircular rope receiving groove 92 which merges downwardly into a pair of diverging grooves 93 and 94.

Wire rope 64 interconnects tension arms 58 and 59 and yoke assembly 63 by having one end thereof secured to connecting link 61, passing upwardly and long groove 93 of plate number 88, around groove 92 and downwardly along groove 94, and having the opposite end thereof connected to connecting link 62. Referring to the FIG. 6, it will be noted that such opposite end of the wire rope passes along groove 85 in connecting link 62 where it is secured by means of a clamp assembly 95 and is inserted into opening 86, the lower end of which forms a socket. As shown, in FIG. 6, the end strands of the wire rope are separated and embedded in a metal poured into the socket and permitted to solidify. The other end of wire rope 64 similarly is secured to connecting link 61.

Figure 2:
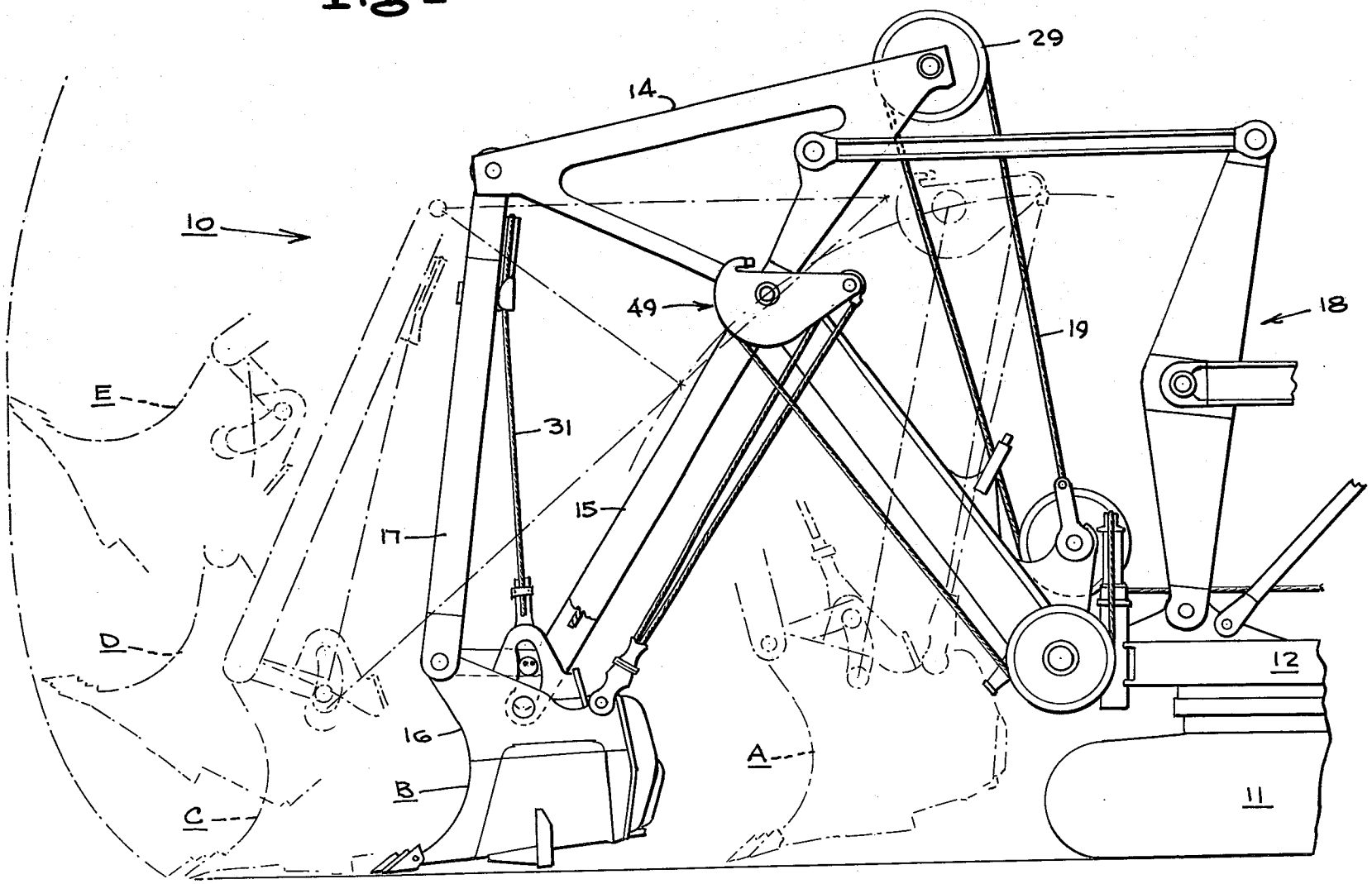
FIG. 2 is a view similar to the view of FIG. 2, illustrating the front end assembly in a sequence of positions during a portion of the digging cycle of the shovel.

The operation of pitch stop assembly 31 is best illustrated in FIG. 2. Referring to FIG. 2, when the dipper is in the lower, fully retracted position, as designated by the reference letter A, at the beginning of the crowding phase of the digging cycle, the dipper will be pitched upwardly, adjacent abutment stops 32. Under such conditions, further upward pitch of the dipper will be prevented by pitch stop assembly 31 by virtue of the stub shaft portions of connecting links 61 and 62 engaging the upper abutment surfaces of the slots in plates 55 and 56, causing wire rope 64 to restrain further pivotal movement of the dipper relative to the crowd handle. As the controls on the shovel are operated to pay out crowd and take in hoist, as previously described, the dipper will move forwardly from the position designated by reference letter A to the position designated by reference letter B, assuming a horizontal attitude at grade level. As such movement occurs, the stub shaft portions in the slots will be caused to move downwardly (relatively) towards the lower abutment surfaces thereof. As the bucket continues to be crowded and moves from the position designated by the reference letter B to the position designated by the reference letter C, representing the furthest point of travel during the crowding phase of the cycle, the stub shaft portions of the connecting links continue to move downwardly toward the lower abutment surfaces of the slots.

With the dipper in position C, the holding cylinder of the pitch control system is released thus causing the dipper to pitch upwardly relative to the dipper handle, to the position as illustrated by the reference letter D. As such occurs, the dipper also will be pivoted in a clockwise direction relative to the hoist link causing the stub shaft portions of connecting links 61 and 62 to move upwardly (relatively) in the slots of plates 55 and 56, and engage the upper abutment surfaces of the slots. Such engagement will restrict further upward pitch of the dipper. As the dipper continues to be hoisted, to a position as designated by the reference letter E and subsequent positions, the upward pitch of the dipper relative to the dipper handle will continue to be restrained by the pitch stop assembly.

When the stub shaft portions of connecting links 61 and 62 are not in engagement with the upper abutment surfaces of the slots, wire rope 64 is prevented from becoming slack by means of tension arms 58 and 59 which maintain the rope in tension. Under such circumstances, the rope is prevented from flapping which under normal operating conditions would cause the wires to wear and eventually require replacement. Also during the crowding phase of the digging cycle, whenever an object such as a stray rock and the like may become lodged between either of the tension arms and the dipper, the dipper is not prevented from pitching downwardly by the tension arms by virtue of the fact that the tension arms would be permitted to be displaced angularly relative to shaft 60. Upon being displaced in such a manner, the tension arms will be maintained in such angularly displaced positions by the brake linings provided between the tension arms and shaft 60 until the end of the crowding phase of the cycle at which time the dipper will pitch upwardly causing the upper abutment surfaces of the slots to engage the stub shaft portions of connecting links 61 and 62 and, correspondingly, to pivotally displace tension arms 58 and 59 downwardly relative to the hoist link thereby causing the tension arms again to stretch the wire rope taut.

Figure 7:
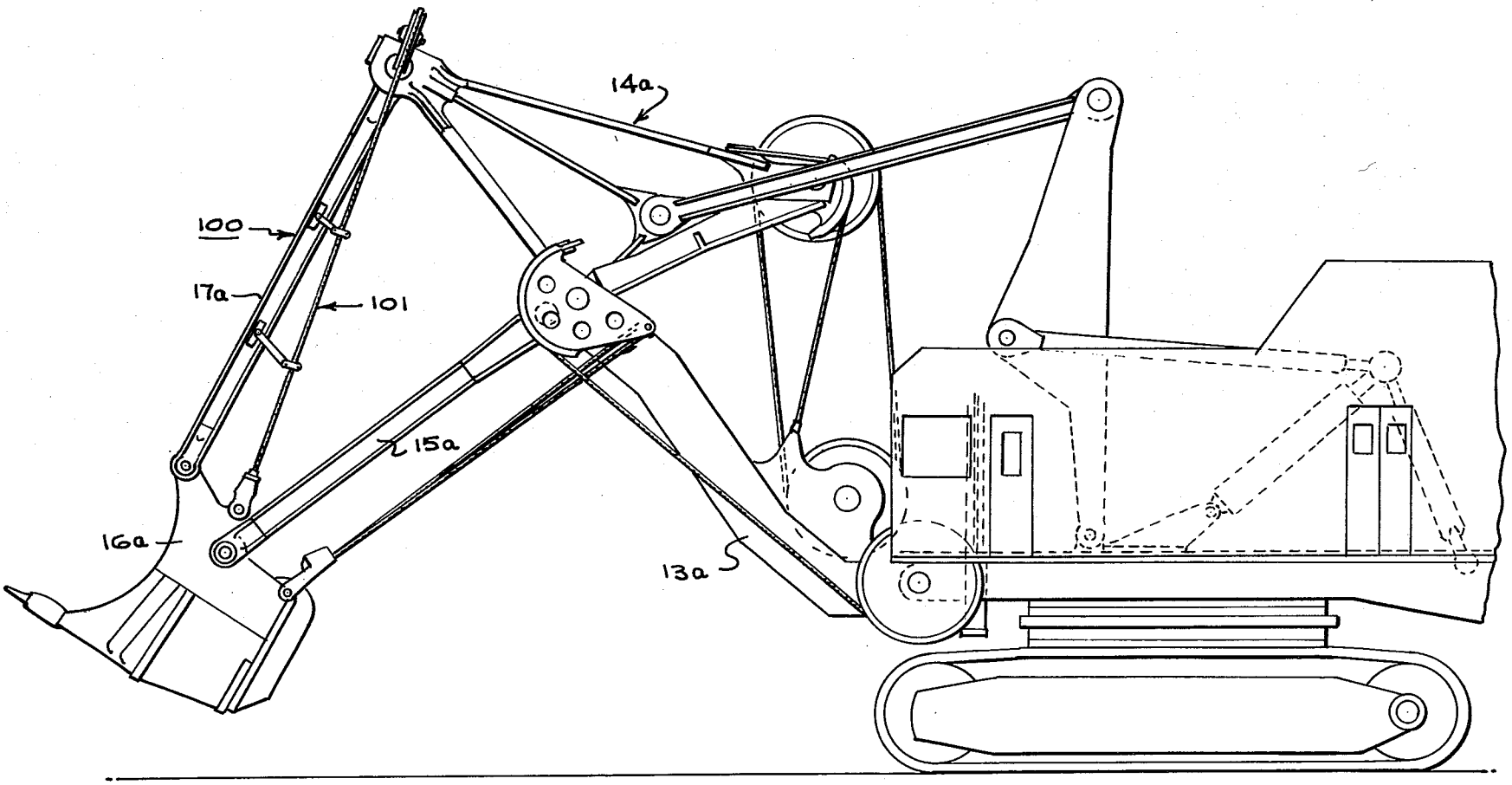
FIG. 7 is a side elevational view of a power shovel including another embodiment of the present invention.
Figure 8:
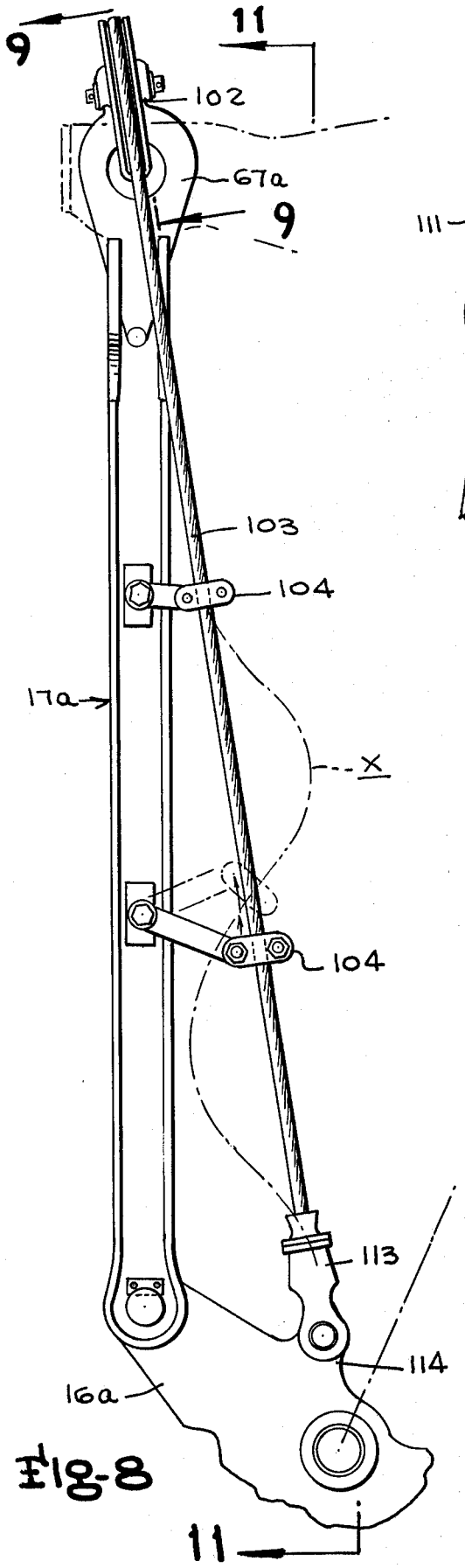
FIG. 8 is a side view of the pitch stop assembly shown in FIG. 7.
Figure 9:
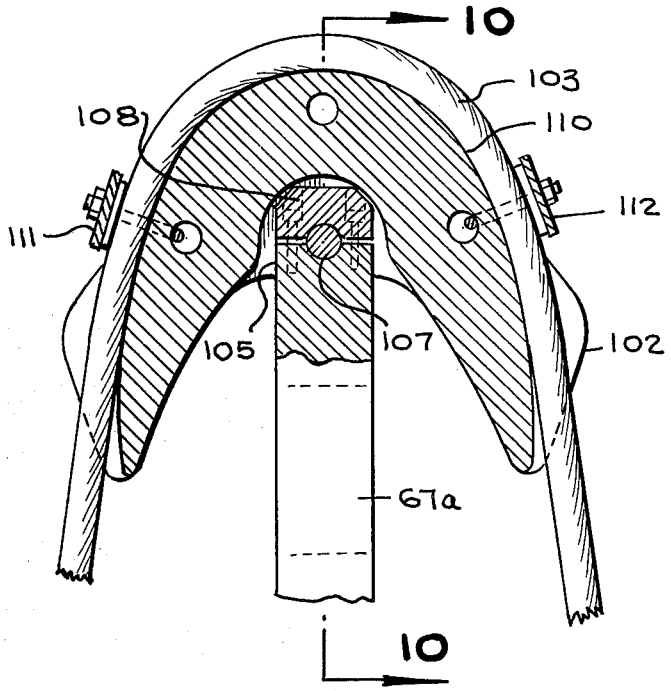
FIG. 9 is an enlarged cross-sectional view taken along line 9—9 in FIG. 8.
Figure 10:
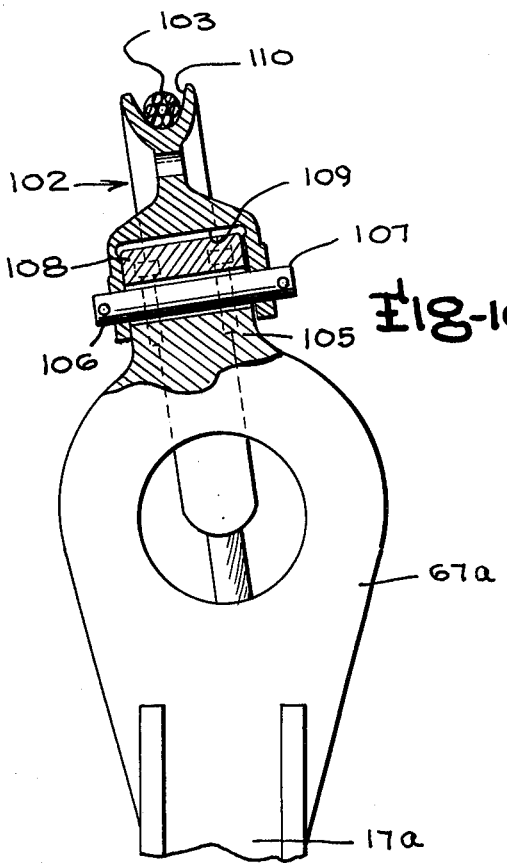
FIG. 10 is a cross-sectional view taken along line 10—10 in FIG. 9.
Figure 11:
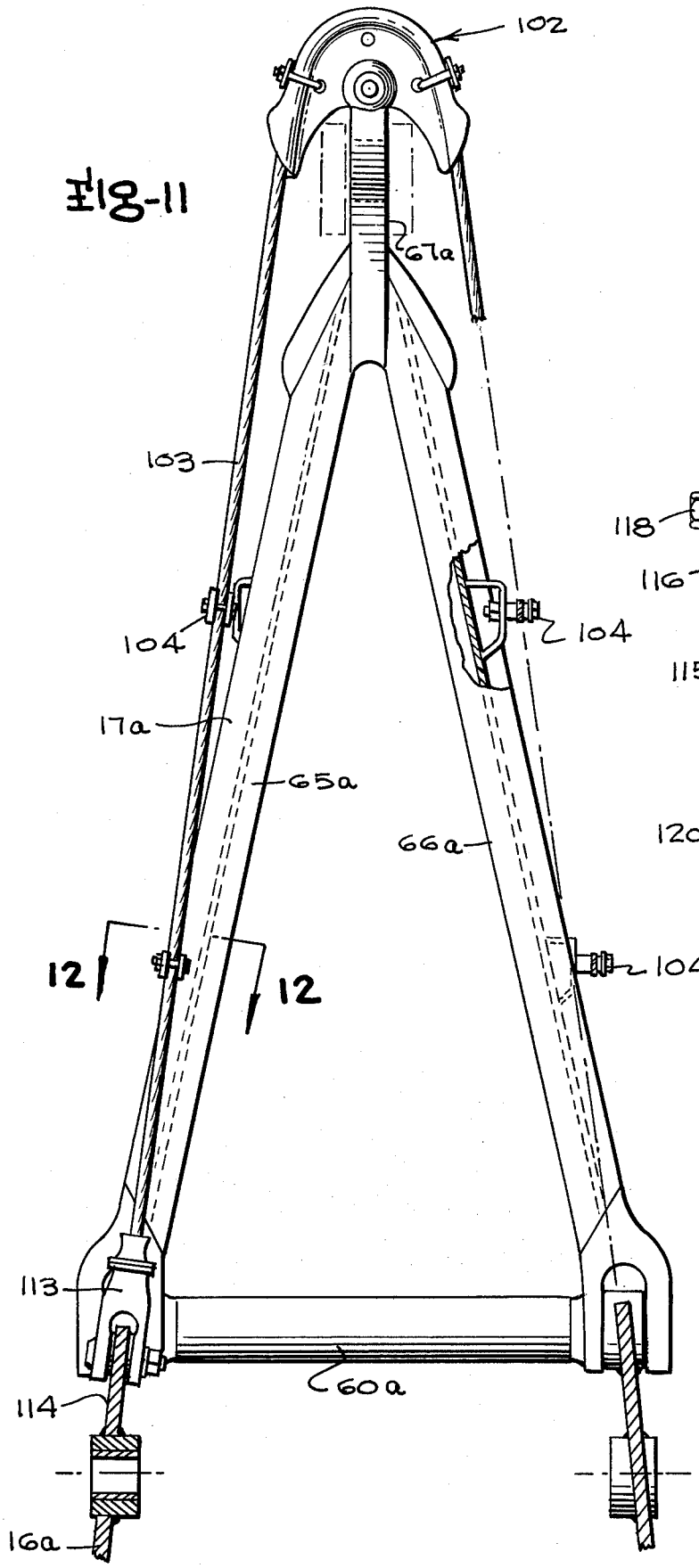
FIG. 11 is a cross-sectional view taken along line 11—11 in FIG. 8.

FIG. 7 illustrates a power shovel 100 which is similar in construction and operation to the shovel illustrated in FIG. 10 but which is equipped with an alternate pitch stop assembly 101 also embodying the present invention. Similar to the shovel shown in FIG. 1, power shovel 100 is provided with a front end assembly including a stiffleg **13*a*, a hoist frame 14*a*, a dipper handle 15*a*, a dipper 16*a*, and a hoist link 17*a*. As best shown in FIGS. 8 and 11, hoist link 17*a* has an inverted, V-shaped configuration including a pair of side beam members 65*a* and 66*a* secured at their upper ends to a hoist frame connecting member 67*a*, and interconnected at the lower ends thereof by a shaft 60*a*** having aligned pins at the ends thereof pivotally connected to the upper front ends of the side walls of the dipper.

Pitch stop assembly 101 generally includes a yoke assembly 102 pivotally mounted on hoist frame connecting member **67*a*, a wire rope 103 interconnecting the side walls of the dipper and yoke assembly 102, and a plurality of guide links 104 mounted on the side beam members of the hoist frame and operatively connected to wire rope 103. Referring to FIG. 10, hoist frame connecting member 67*a* is provided with an upwardly extending portion 105, having a longitudinally disposed groove 106 for receiving a lower half of a pivot pin 107. The pivot pin is held in position by means of a retainer block 108 provided with a longitudinal groove receiving the upper half of the pin, which is secured to projecting portion 105 by means of a plurality of bolts. The yoke assembly has an inverted, U-shaped configuration straddling connection member 67*a*, including a recessed portion 109 on the underside thereof for receiving retainer block 108 and the upper end of projecting portion 105. Pivot pin 107 projects through aligned openings in the yoke assembly so that the yoke assembly is adapted to pivot within a limited angle about the axis of pivot pin 107. The outer edge of the yoke assembly is provided with a groove 110 for receiving the intermediate portion of wire rope 103. Such portion of the rope is retained in groove 103 by means of clamp assemblies 111 and 112**.

As best shown in FIG. 11, wire rope 103 is provided at one end thereof with a rope socket 113 rigidly connected to an upwardly projecting portion 114 of a side wall of the dipper, passes upwardly and around the yoke assembly in groove 110 and passes downwardly where it is rigidly connected at the opposite end thereof by a rope socket to an upwardly projecting portion of the opposite dipper side wall, disposed in transverse alignment with upwardly projecting portion 114. Each end of the rope particularly is rigidly connected to a side wall of the dipper in that such rigid connection functions to control an end of the slack curve of the rope. The length of wire rope 103 is adjusted so that upon the upward pitch of the dipper at the end of the crowding phase of the digging cycle, when the pitch control system has been released, the upward pitch of the dipper will be limited, as previously described.

Figure 12:
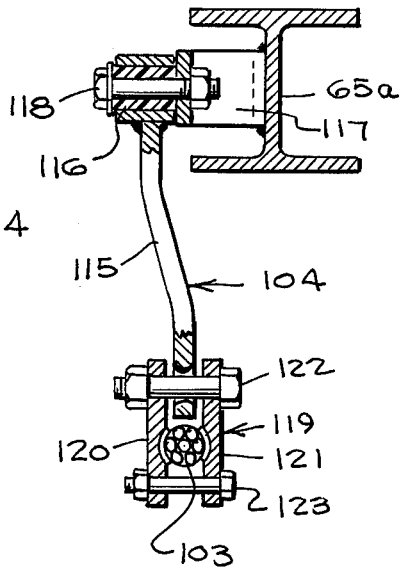
FIG. 12 is an enlarged cross-sectional view taken along line 12—12 in FIG. 11.

The slack developed in wire rope 103 when the rope is not placed in tension by the angular displacement of the dipper relative to the hoist link, is controlled by the plurality of guide linkages 104. The linkages function in a manner so as to permit the rope to slacken yet not displace appreciably from its taut position, possible oscillating uncontrollably which would cause wear and possibly failure after a short time in service. Referring to FIG. 12, each linkage consists of a link 115 pivotally mounted on a bushing 116 secured to a bracket 117 disposed on a side beam member of the hoist frame, by means of a bolt and nut set 118, and a link 119 consisting of a pair of clamp members 120 and 121 pivotally connected to the end of link 115 and clamped to wire rope 103 by means of a pair of bolt and nut sets 122 and 123.

Referring to FIG. 8, the wire rope is illustrated in the taut position by the solid lines. However, when the rope becomes slack, as represented by the broken line X, guide linkages 104 will permit the rope to slacken in a controlled manner within acceptable displacement limits.

The load imposed by the wire rope on the yoke assembly is intended to be transmitted to the hoist frame connecting member through retainer block 108 and not through pivot pin 107 which is intended only for safety purposes. The yoke assembly is free to rock on the upper end of the connecting member so that the rope will not restrain torsional deflection of the dipper, and the stop load on the hoist link will not become eccentric.

Preferably, pitch stop assembly 101 is designed so that the radius of curvature of the slackened rope is nowhere less than about 12 rope diameters, so that fatigue due to bending of the wire does not create a problem. The curve of the rope can be predicted with reasonable accuracy because the direction of the rope is known at each end, and the level of two intermediate points on the curve is controlled. Furthermore, since the dipper is more or less directly under the ball joint connection between the hoist link and the hoist frame while pitch is being held, it is certain that all slack will tend to accumulate near the lower ends of the rope.

In view of the foregoing, it will be noted that the present invention provides the advantages of (a) greatly simplifying the construction of the dipper handle, (b) reducing the amount of weight near the head shaft which is desirable for preventing slack hoist, (c) increasing the weight near the ball joint connection between the hoist link and hoist frame which also is desirable for preventing slack hoist, (d) eliminating the necessity for rubber in the pitch stops since the rope itself is capable of stretching sufficiently to serve as a cushion, (e) reducing the overall weight of the front end assembly since ropes are much lighter than columns, (f) slightly increasing the compressive load in the handle when pitch is not being held, thus reducing tension on one side of the handle due to lateral loads applied to the dipper, and (g) slightly reducing the tensile load in the hoist link while pitch is not being held since tension in the ropes carries some of such load.

From the foregoing detailed description, it will be evident that there are a number of changes, adaptations and modifications of the present invention which come within the province of those persons having ordinary skill in the art to which the present invention pertains. However, it is intended that all such variations not departing from the spirit of the invention be considered as within the scope thereof, as limited solely by the appended claims.

I claim:

1. In a power shovel including a base unit; a support unit rotatably mounted on said base unit; a front end assembly including a stiffleg pivotally connected at a lower end thereof to said support unit, a dipper handle operatively connected to said stiffleg, a dipper pivotally connected to said dipper handle, a hoist frame pivotally connected to said stiff leg, and a hoist link pivotally connected at the ends thereof to said hoist frame and said dipper, said dipper handle, dipper, hoist link and hoist frame defining a four bar linkage; a crowd system operatively interconnecting said support unit and said front end assembly; a hoist system operatively interconnecting said support unit and said front end assembly; and control means mounted on said support means for operating said crowd and hoist systems to crowd, hoist, lower and retract said dipper, a pitch stop assembly comprising a flexible tension member interconnecting selected points of two different components of said four bar linkage for limiting the angular displacement of said dipper relative to said handle when said dipper is caused to pitch upwardly.

2. A pitch stop assembly according to claim 1 wherein said flexible tension member comprises a wire rope.

3. A pitch stop assembly according to claim 1 including means for maintaining said flexible tension member taut when said collapsible tension member is not placed in tension by said two components of said four bar linkage.

4. A pitch stop assembly according to claim 1 including means for controlling the slack in said flexible tension member when said flexible tension member is not placed in tension by said two components of said four bar linkage.

5. In a power shovel including a base unit; a support unit rotatably mounted on said base unit; a front end assembly including a stiffleg pivotally connected at a lower end thereof to said support unit, a dipper handle operatively connected to said stiffleg, a dipper pivotally connected to said dipper handle, a hoist frame pivotally connected to said stiff leg, and a hoist link pivotally connected at the ends thereof to said hoist frame and said dipper, said dipper handle, dipper, hoist link and hoist frame defining a four bar linkage; a crowd system operatively interconnecting said support unit and said front end assembly; a hoist system operatively interconnecting said support unit and said front end assembly;

and control means mounted on said support means for operating said crowd and hoist systems to crowd, hoist, lower and retract said dipper, a pitch stop assembly comprising a collapsible tension member interconnecting two pivotal connecting points of said four bar linkage for limiting the angular displacement of said dipper relative to said handle when said dipper is caused to pitch upwardly.

6. A pitch stop assembly according to claim 5 wherein said collapsible tension member comprises a wire rope.

7. A pitch stop assembly according to claim 5 including means for maintaining said collapsible tension member taut when said member is not placed in tension by said two pivotal connecting points of said four bar linkage.

8. A pitch stop assembly according to claim 5 including means for controlling the slack of said collapsible tension member when said collapsible tension member is not placed in tension by said two pivotal connecting points of said four bar linkage.

9. In a power shovel including a base unit; a support unit rotatably mounted on said base unit; a front end assembly including a stiffleg pivotally connected at a lower end thereof to said support unit, a dipper handle operatively connected to said stiffleg, a dipper pivotally connected to said dipper handle, a hoist frame pivotally connected to said stiff leg, and a hoist link pivotally connected at the ends thereof to said hoist frame and said dipper, said dipper handle, dipper, hoist link and hoist frame defining a four bar linkage; a crowd system operatively interconnecting said support unit and said front end assembly; a hoist system operatively interconnecting said support unit and said front end assembly; and control means mounted on said support means for operating said crowd and hoist systems to crowd, hoist, lower and retract said dipper, a pitch stop assembly comprising a collapsible tension member interconnecting points on said dipper and said hoist link for limiting the angular displacement of said dipper relative to said handle when said dipper is caused to pitch upwardly.

10. A pitch stop assembly according to claim 9 wherein said collapsible tension member comprises a wire rope.

11. A pitch stop assembly according to claim 9 including means for maintaining said collapsible tension member taut when said collapsible tension member is not placed in tension by said dipper and said hoist link.

12. A pitch stop assembly according to claim 9 including a yoke mounted on said hoist link, and wherein said collapsible tension member comprises a wire rope being operatively connected at one end thereof to a side of said dipper, passing around said yoke and being operatively connected at an opposite end thereof to an opposite side of said dipper.

13. A pitch stop assembly according to claim 9 including means for controlling the slack of said collapsible tension member when said member is not placed in tension by said hoist link and said dipper.

14. A pitch stop assembly according to claim 13 including a yoke mounted on said hoist link, and wherein said collapsible tension member comprises a wire rope being operatively connected at one end thereof to a side of said dipper, passing around said yoke and being operatively connected at the opposite end thereof to an opposite side of said dipper.

15. A pitch stop assembly according to claim 9 including at least one rigid arm member mounted on said hoist link and pivotal therewith relative to said dipper, operatively connected to said collapsible tension member for maintaining said collapsible tension member taut when said collapsible tension member is not placed in tension by said hoist link and said dipper.

16. A pitch stop assembly according to claim 15 wherein said collapsible tension member comprises a wire rope.

17. A pitch stop assembly according to claim 15 including a yoke mounted on said hoist link, and wherein said collapsible tension member comprises a wire rope being operatively connected at one end thereof to a side of said dipper, passing around said yoke and being operatively connected at the opposite end thereof to an opposite side of said dipper.

18. A pitch stop assembly according to claim 17 wherein said arm member may be angularly displaced relative to said hoist link when predetermined loads are applied to said dipper causing said dipper to pivot relative to said hoist link and engage said arm member.

19. A pitch stop assembly according to claim 9 including at least one arm member mounted on said hoist link and projecting substantially radially relative to the axis of the pivotal connection between said hoist link and said dipper, and operatively connected to said collapsible tension member for maintaining said collapsible tension member taut when said collapsible tension member is not placed in tension by said hoist link and said dipper.

20. A pitch stop assembly according to claim 19 wherein said collapsible tension member comprises a wire rope.

21. A pitch stop assembly according to claim 19 including a pair of said arm members and a yoke mounted on said hoist link, and wherein said collapsible tension member comprises a wire rope being operatively connected at one end thereof to one of said arm members, passing around said yoke and being operatively connected at the other end thereof to the other of said arm members.

22. A pitch stop assembly according to claim 19 wherein said arm member is angularly displacable relative to said hoist link when a predetermined load is applied to said dipper causing said dipper to pivot relative to said hoist link and engage said arm member.

23. A pitch stop assembly according to claim 1 including a pair of arm members mounted on said hoist link and disposed substantially radially relative to the axis of the pivotal connection between said hoist link and said dipper, including a yoke mounted on said hoist link, wherein said flexible tension member comprises a wire rope rigidly secured at one end thereof to one of said arm members, passing around said yoke member and being rigidly connected at its opposite end thereof to the other of said arm members, maintaining said wire rope taut, and wherein said dipper includes pairs of arcuately spaced abutments engageable by said arm members when said dipper is pivoted relative to said hoist link.

24. A pitch stop assembly according to claim 23 wherein said pairs of abutments comprise arcutately spaced surfaces of a pair of transversely aligned, arcuate slots having the axis of the pivotal connection between said hoist link and said dipper as a center of curvature, and wherein said arm members include stub shafts received within said slots.

25. A pitch stop assembly according to claim 23 wherein said arm members are angularly displaceable relative to said hoist link when predetermined loads are applied to said dipper causing said dipper to pivot relative to said hoist and said arm members to engage said abutments.

26. A pitch stop assembly according to claim 9 wherein said means for controlling the slack of said collapsible tension member comprises a plurality of spaced links mounted on said hoist link and operatively connected to said collapsible tension member along the length thereof.

27. A pitch stop assembly according to claim 26 wherein said collapsible tension member comprises a wire rope.

28. A pitch stop assembly according to claim 9 including a yoke mounted on said hoist link, wherein said collapsible tension member comprises a wire rope being rigidly connected at one end thereof to a side of said dipper, passing around said yoke and being rigidly connected at the opposite end thereof to said dipper, and including a plurality of guide links mounted on said hoist link and connected to said wire rope in clamping relation for controlling the slack of said wire rope when said wire rope is not placed in tension by said dipper and said hoist link.

29. A pitch stop assembly according to claim 28 wherein each of said guide links is pivotally connected to said hoist link.

30. A pitch stop assembly according to claim 29 wherein each of said guide links includes a first link pivotally connected to said hoist link and a second link pivotally connected to said first link and being clamped to said wire rope.

* * * * *

UNITED STATES PATENT AND TRADEMARK OFFICE

CERTIFICATE OF CORRECTION

PATENT NO. : 4,085,854

DATED : April 25, 1978

INVENTOR(S) : BARON, George B.

It is certified that error appears in the above-identified patent and that said Letters Patent are hereby corrected as shown below:

Column 4, line 26 delete "33".

Column 4, line 47 delete "ridigly" and insert --rigidly--

Column 6, line 6 delete "60" and insert --56--

Column 7, line 17 delete "long" and insert --along--

Column 7, line 18 delete "number" and insert --member--

Column 8, line 32 delete "10" and insert --1--

Column 9, line 25 delete "possible" and insert --possibly--

Claim 3, line 3 delete "collapsible" and insert --flexible--

Signed and Sealed this

*Nineteenth* Day of *September 1978*

[SEAL]

*Attest:*

RUTH C. MASON
*Attesting Officer*

DONALD W. BANNER
*Commissioner of Patents and Trademarks*